US005446005A

United States Patent [19]

Endo

[11] Patent Number: 5,446,005

[45] Date of Patent: Aug. 29, 1995

[54] PITCH-BASED ACTIVATED CARBON FIBER

[76] Inventor: Morinobu Endo, 615, Kitahara-cho, Suzaka-shi, Nagano-ken, Japan

[21] Appl. No.: 79,819

[22] Filed: Jun. 22, 1993

[30] Foreign Application Priority Data

Jun. 25, 1992 [JP] Japan ..... 4-167166

[51] Int. Cl.[6] ..... B01J 20/20

[52] U.S. Cl. ..... 502/433; 502/416; 502/430; 423/447.2; 423/447.6

[58] Field of Search ..... 502/434, 433, 416, 430; 423/447.6, 447.2

[56] References Cited

U.S. PATENT DOCUMENTS 4,412,937 11/1983 Ikegami et al. ..... 502/417
4,734,394 3/1988 Kosaka et al. ..... 502/434
5,238,672 8/1993 Sumner et al. ..... 423/447.7

FOREIGN PATENT DOCUMENTS 0366539 5/1990 European Pat. Off. .

OTHER PUBLICATIONS

WPI/Derwent, AN-92-196315, JP-A-4 126 825, Apr. 27, 1992.

*Primary Examiner*—Anthony McFarlane
*Attorney, Agent, or Firm*—Oblon, Spivak, McClelland, Maier, & Neustadt

[57] ABSTRACT

There is disclosed an optically isotropic pitch-based activated carbon fiber which has a proportion of the number of ultramicropores with a pore diameter of 0.5 nm or smaller to the total number of pores with a pore diameter of 4 nm or smaller being at least 70%; a specific surface area of 500 to 3000 $m^2/g$; and the pores consisting substantially only of the pores with a pore diameter of 4 nm or smaller, which are allowed to three-dimentionally communicate with at least a part of the surrounding pores and are distributed with an almost uniform density throughout the fiber including the surface layer part and the inner part of the fiber. The above activated carbon fiber has a high adsorption efficiency without decrease in mechanical strength and is effectively utilized as adsorbents for low molecular organic compounds and inorganic compounds, adsorbents for trace amounts of radioactive substances, catalyst carriers, electrodes for secondary batteries, etc.

2 Claims, No Drawings

PITCH-BASED ACTIVATED CARBON FIBER

BACKGROUND OF THE INVENTION

1. Field of the Invention

The present invention relates to pitch-based activated carbon fibers. More particularly, it pertains to optically isotropic pitch-based activated carbon fibers in which the relative proportion of the number of ultramicropores, pore diameters and pore densities (the number of pores per unit volume of the fiber) are regulated and which selectively exhibit a high adsorption efficiency according to various purposes of use and are particularly suited for adsorbents for low-molecular organic compounds and inorganic compounds, adsorbents for trace amounts of radioactive substances, catalyst carriers, electrodes for secondary batteries and the like.

2. Description of the Related Arts

Particulate activated charcoals and activated carbon fibers have heretofore been known as materials exhibiting the capability of adsorbing and desorbing a variety of substances and ions. In particular, being in the form of fibers, activated carbon fibers have come to be widely used, with or without additional treatment such as shaping, as materials for adsorbing applications such as absorbent, water purifiers, deodorant or deodorizing filters, catalyst carriers and applications making use of the intercalation potential of ions to carbon such as batteries, capacitors or condensers.

In order that the particulate activated charcoals or activated carbon fibers may fully exhibit their adsorption-desorption functions, size and density and/or distribution of the pores as well as structure of the pores are generally considered to be significant factors.

However, adjustment of the diameter, the density and the distribution of the pores is extremely difficult because they are varied depending on raw pitch materials and production conditions. In fact, Japanese Patent Application Laid-Open No. 295218/1986 discloses a technique for controlling the distribution of the pores in an optically isotropic pitch-based activated carbon fiber according to the purpose of applications.

However, nothing is known about conventional particulate activated charcoals or activated carbon fibers in which the distribution of the pores in the inner part of the fiber is controlled, for example, how to achieve a uniform density of the pores.

Taking into consideration the size of low molecular organic compounds, inorganic compounds, metal atoms, ions or the like, activated charcoals or activated carbon fibers each having ultramicropores of 0.5 nm or smaller in pore diameter are expected to find a variety of applications. However, it has been impossible with any of the conventional technique to control the relative proportion of the number of ultramicropores therein. As the result of investigation on various activated charcoals, there has not yet been found an activated charcoal having a proportion of the number of ultramicropores with a pore diameter of 0.5 nm or smaller to the total number of being from 70% to 92% opores with a pore diameter of 4 nm or smaller which proportion exceeds 70%.

When an activated carbon fiber has pores distributed uniformly not only in the surface layer part but also in the inner part of the fiber, the number of the pores in the unit volume of the fiber is increased and accordingly, the efficiency of the adsorption by the fiber is enhanced.

The fiber having such a structure is expected to find a still wider range of applications.

However, hitherto none of the conventional particulate activated charcoals and activated carbon fibers has sufficiently met the above-mentioned requirement regardless of the origin such as pitch-based materials or organic materials, including rayon-based, polyacrylonitrile-based, phenol resin-based and the other materials.

The pores can be classified in macropores having a diameter of 50 nm or larger, mesopores having a diameter in the range of 5 to 50 nm, micropores having a diameter in the range of 0.5 to 5 nm and ultramicropores having a diameter of 0.5 nm or smaller.

The pores structures of the conventional particulate activated charcoals and activated carbon fibers are roughly classified in a structure in which macropores are in the surface layer part of the fiber, mesopores are in the inner part thereof and micropores along with ultramicropores are in the further inner part thereof, and a structure in which mesopores are in the surface layer part of the fiber and micropores along with ultramicropores are in the inner part thereof.

It is generally believed that micropores are the most effective for the adsorption. In the conventional materials, the micropores are developed straight forward and are distributed mainly in the part close to the surface of the material and the diameter thereof reduces monotonously with the distance from the surface.. To attain higher adsorption efficiency in this kind of structure, the number of pores in the surface layer must be increased resulting in the problem that the mechanical strength of the material is inevitably deteriorated. In addition, nothing has heretofore been known regarding an activated carbon fiber having ultramicropores of 0.5 nm or smaller in pore diameter as principal pores.

As a result of extensive investigation made by the present inventor in order to solve the above-mentioned problem, it has been found that optically isotropic pitch-based activated carbon fibers are obtained in which the relative proportion of the number of ultramicropores, pore diameters and pore densities are properly regulated; a large number of micropores and ultramicropores that communicate with at least a part of the surrounding pores are distributed with an almost uniform density on the surface layer part and also in the inner part of the fibers; and substantially the micropores having a pore diameter larger than 4 nm are not recognized, by regulating the preparation conditions for optically isotropic pitch, spinning and/or infusibilizing conditions for the pitch fibers, carbonizing conditions and further, activating treatment conditions for the infusibilized pitch fibers and/or the carbonized pitch fibers. The present invention has been accomplished on the basis of the above-mentioned finding.

Specifically, the present invention provides optically isotropic pitch-based activated carbon fibers having a proportion of the number of the ultramicropores with a pore diameter of 0.5 nm or smaller to the total number of pores with a pore diameter of 4 nm or smaller being at least 70%.

SUMMARY OF THE INVENTION

The optically isotropic pitch-based activated carbon fibers according to the present invention have a proportion of the number of the ultramicropores with a pore diameter of 0.5 nm or smaller to the total number of the pores with a pore diameter of 4 nm or smaller being at least 70%, have no macropore and substantially no mesopore in the surface layer part of the fibers, but instead have micropores with a pore diameter of 4 nm or smaller that are open directly to the surfaces of the fibers.

DESCRIPTION OF PREFERRED EMBODIMENT

Particularly desirable activated carbon fibers are those that have a specific surface area as determined by BET method in the range of 500 to 3,000 $m^2/g$ and are provided with substantially only the micropores with a pore diameter of 4 nm or smaller (including ultramicropores in addition to micropores) that are allowed to three-dimensionally communicate with at least a part of the surrounding pores and are distributed with an almost uniform density over the whole zone including the surface layer part and the inner part of the fibers. When a cross section of the pitch-based activated carbon fiber having such features according to the present invention is observed with a transmission electron microscope, no irregularity caused by macropores is recognized on the outer periphery of the cross section of the fiber.

In addition, when the cross section thereof is observed at a magnification of ×300,000 or more and the micropore sizes are examined by binarizing treatment of the resultant image, it is proved that merely the micropores with a pore diameter of 4 nm or smaller (including ultramicropores in addition to micropores) are present in a large number and that the difference in the pore density between the surface layer part of the fiber and the inner part thereof is within 5%.

Moreover, when the pore form at a cross section of the fiber was examined by fractal analysis, the fractal dimension is found to vary depending e.g. on the specific surface area and lie in the range of 2.1 to 2.9. The fractal analysis was performed according to the ordinary method by varying the degree of roughness of view (the scale). Specifically, the fractal dimension was obtained by a method wherein a pattern obtained by the image treatment of a micrograph taken with a transmission electron microscope was divided into a large number of squares, the length of the side of the squares was varied, the number of the squares that were completely contained within the pore area was counted, and the degree of the change in the number of the squares with the change in the length of the side thereof was numerically expressed.

Since the pore form remains almost unchanged irrespective of the direction of the cross section of the fiber, it can be said that the micropores are allowed to three-dimensionally communicate with at least a part of the surrounding pores extending not straight forward.

It is most desirable for enhancing the adsorption efficiency of the activated carbon fibers that a pore communicates with all the pores surrounding it.

However, when a pore communicates with at least a part of the surrounding pores, the adsorption efficiency is enhanced and the function of the activated carbon fiber as the adsorbing material can sufficiently be exhibited.

It is preferable that the relative proportion of the number of the ultramicropores with a pore diameter of 0.5 nm or smaller to the number of the pores with a pore diameter of 4 nm or smaller be at least 70%, said relative proportion being obtained by binarizing treatment for the image of the cross section of the fiber which image is observed with a transmission electron microscope.

The relative proportion of the number of ultramicropores, the pore diameter and the pore density are controlled by the preparation conditions for optically isotropic pitch, spinning and/or infusibilizing conditions for the pitch fibers, carbonizing conditions and further, activating treatment conditions for the infusibilized pitch fibers and/or the carbonized pitch fibers. The appropriate control of the above-mentioned conditions enables the production of the activated carbon fibers having the aforestated features, that is, the activated carbon fibers in which the proportion of the number of the ultramicropores with a pore diameter of 0.5 nm or smaller to the total number of the pores with a pore diameter of 4 nm or smaller is at least 70%, the micropores are distributed with an almost uniform density over the whole zone including the surface layer part and the inner part of the fibers and are allowed to communicate with at least a part of the surrounding pores and which have a specific surface area in the range of 500 to 3,000 $m^2/g$.

The activated carbon fibers of the present invention have a higher mechanical strength and the advantage of suffering less damage during handling even when the adsorption efficiency is enhanced as compared with conventional activated carbon fibers.

The optically isotropic pitch-based carbon fibers having such features according to the present invention can be prepared by any of various processes through the proper control for the above-described conditions. The preferable examples of preparation process among them will be described hereunder.

An optically isotropic pitch is utilized as a pitch material for spinning in the preparation of the activated carbon fiber of the present invention because of its easiness of activation.

The kind of raw pitch material utilized for preparing the optically isotropic pitch is not specifically limited insofar as the pitch material gives optically isotropic pitch of a high softening point by a treatment such as the heat treatment under blowing with an oxygen-containing gas. Examples of the raw pitch material utilized for the preparation of the optically isotropic pitch include materials prepared from residual oil from crude oil distillation, residual oil from naphtha cracking, ethylene bottom oil, liquefied coal oil or coal tar by treatments such as filtration, purification, distillation, hydrogenation and catalytic cracking. Among them is particularly desirable petroleum oil-based catalytic-cracking heavy oil.

The optically isotropic pitch can be prepared from the raw pitch material, for example, by the following process comprising the steps of (a), (b), (c) and (d):

(a) The raw pitch material is heat treated while blowing with an inert gas such as nitrogen at a temperature in the range of 350° to 450° C. to produce a heat treated pitch material containing about 5% by weight of optically anisotropic components. Then the optically anisotropic components are separated and removed from the heat treated pitch material.

(b) The resultant pitch material is heat treated while blowing with an oxygen-containing gas at a temperature in the range of 150° to 380° C., preferably 280° to 350° C. As the oxygen-containing gas, air or an oxygen-rich gas may be utilized, but air is preferable because it is readily available. Sufficient treatment with oxygen in this stage is important. Insufficient treatment with oxygen or blowing with an inert gas such as nitrogen is unfavorable since any of them increases the content of optically anisotropic components in the product and makes it difficult to control the pore diameter and pore distribution as the object of the present invention.

The amount of oxygen required for the heat treatment is generally in the range of 0.2 to 10 NL/minute per 1 kg of the pitch. A heat treatment temperature lower than 150° C. is unfavorable since it lowers the reactivity, whereas a temperature higher than 380° C. is also unfavorable because the control of the reaction is made difficult and besides, the preparation of the activated carbon fiber having a uniform pore diameter according to the present invention is made difficult.

The pitch prepared by the heat treatment under the condition described above has a high softening point as measured by the Metier method or by the Ring and Ball (R. B.) method in the range of 150° to 300° C., preferably 200° to 250° C. and contains quinoline-insoluble components in the range of several to 15% by weight;

(c) The above heat treated pitch is filtered by using a disc filter, such as a DIPS filter of 0.3 to 3 μm, at a temperature higher than the softening point of the pitch by about 50° C. to remove the quinoline-insoluble components substantially completely.

The method of removing the quinoline-insoluble components is not particularly limited to the method described above, but any other method which can remove the quinoline-insoluble components without affecting the quality of the pitch may be utilized including the methods such as separation by the difference in specific gravity and centrifugal separation; and (d) The above-obtained pitch from which the quinoline-insoluble components have been removed is heat treated at a high temperature under a reduced pressure with blowing of gas. The heat treatment is stopped before optically anisotropic components are formed to produce the optically isotropic pitch.

Importance should be attached to the use of an inert gas, preferably, nitrogen or argon or an inert gas containing trace amount of steam for the aforesaid treatment under reduced pressure.

The aforesaid heat treatment under a reduced pressure is effected by the use of the aforesaid gas at a pressure in the range of 1 to 15 Torr (133 to 2000 Pa) and an elevated temperature in the range of 310° to 360° C. for 20 minutes to 2 hour, thus affording the pitch having a softening point in the range of 250° to 290° C. and substantially free from quinoline-insoluble components.

A homogeneous and optically isotropic pitch having a high softening point and a narrow molecular weight distribution can be prepared by the series of the steps (a), (b), (c) and (d) as described above. As the pitch material for preparing the activated carbon fibers of the present invention, the isotropic pitch material prepared through the series of the steps as described above is preferred.

As a method for spinning the optically isotropic pitch of the present invention, conventional melt spinning methods can be utilized. In order to obtain, for example, a material like a nonwoven fabric, the spinning method generally called melt blow method in which the optically isotropic pitch is spun from spinning nozzles placed in a slit where a high speed stream of gas is blown is preferable because of its higher production efficiency.

It is preferable for maintaining uniformity of the optically isotropic pitch fibers that the temperature of the spinneret be held higher than the softening point of the pitch by 20° to 80° C. and that the temperature of the gas stream be held higher than the temperature of the spinneret by 10° to 50° C. Under these conditions, the temperature of the spun pitch is estimated to be somewhat lower than the temperature of the spinneret.

When the softening point of the optically isotropic pitch to be spun is lower than 200° C., a longer time is required for infusibilizing the spun fiber and the productivity thereof is extremely reduced. When the softening point thereof is higher than 300° C., a considerably higher temperature is required for the spinning and the quality of the pitch is deteriorated to cause decrease in the strength of the spun fiber.

Viscosity of the pitch in the spinning according to the invention should be higher than the viscosity according to the conventional melt blow method and in the range of 10 to 200 poise, preferably 30 to 100 poise approximately.

The temperature of the spinneret, the temperature of the gas and the blow speed of the gas vary depending on the viscosity and the softening point of the optically isotropic pitch, physical properties of the finally prepared activated carbon fiber and the like other factors and can not be unequivocally determined.

In general practice, it is preferable that the temperature of the spinneret be in the range of 290° to 360° C., the temperature of the gas be in the range of 300° to 380° C. and the blow speed of the gas be in the range of 200 to 350 m/second.

When the temperature of the spinneret is lower than 290° C., the resultant excessively high viscosity of the pitch causes unstable spinning and decrease in the strength of the prepared fiber. A temperature higher than 360° C. is unfavorable since so-called shot takes place more frequently.

The infusibilizing treatment of the optically isotropic pitch fibers can be conducted according to a conventional method. For example, the treatment can be made by oxidation at a temperature raising rate in the range of 0.2° to 20° C./minute at temperatures from 150° to 400° C., preferably from 180 to 320° C. The treatment can be conducted in an atmosphere such as oxygen-rich gas or air. The atmosphere may partially contain chlorine gas or nitrogen oxide gas.

The infusibilized pitch-based fibers thus obtained can be made into the activated carbon fibers by the moderate carbonization followed by activation or the direct activation.

The moderate carbonization is conducted by carbonization according to a conventional method, for example, at a temperature of 800° C. or lower, preferably in the range of 500°0 to 750° C., and at a temperature raising rate in the range of 5° to 100° C./minute in an inert gas such as nitrogen. Activation of fabricated fibers such as felt and woven fabrics is made possible by having the moderate carbonization before the activation treatment.

The activation treatment is conducted according to a conventional method generally at 800° to 1500° C. for several minutes to 2 hours in an atmosphere such as air, steam or carbon dioxide. The type of usable activation apparatus is not particularly limited but is exemplified by an activation furnace of vertical or horizontal type and an activation furnace of batch or continuous type.

The size and the density of pores of the activated carbon fibers can be adjusted by controlling the activation conditions for the infusibilized pitch fibers and the moderately carbonized pitch fiber.

In more detail, it is possible to prepare the activated carbon fibers which have a small and uniform pore diameter and an almost uniform pore density even if the specific surface area thereof as determined by BET method is almost the same as that of the conventional activated carbon fibers by raising activation temperature and shortening activation time. In order to allow macropores having a relatively large pore diameter to coexist with ultramicropores having a small pore diameter, it is suggested to lower activation temperature and extend activation time.

By virtue of the properly controlled preparation conditions as described hereinbefore, the optically isotropic pitch-based activated carbon fibers according to the present invention are characterized in that they assure a uniform pore density and have a specific surface area of 500 to 3,000 $m^2/g$, a proportion of the number of ultramicropores with a pore diameter of 0.5 nm or smaller to the number of pores with a pore diameter of 4 nm or smaller being at least 70% and substantially only the pores with a pore diameter of 4 nm or smaller, which are allowed to three-dimensionally communicate with at least a part of the surrounding pores, that is, in part or in whole, thus greatly enhancing adsorption capacity with minimized deterioration of its mechanical strength.

The optically isotropic pitch-based activated carbon fibers of the present invention are in the form of fibers and therefore, utilized with or without additional treatment such as shaping, as materials for adsorbing applications, such as gas-phase and liquid-phase adsorbent, water purifiers, deodorant or deodorizing filters, adsorbent for trace amount of radioactive substances, catalysts carriers, fuel cell or carbonaceous electrode materials for secondary batteries.

In the present invention, the pitch fibers spun by using the homogeneous and optically isotropic pitch having a high softening point as spinning material and by e.g. the high viscosity melt blow process are preferably employed. The activated carbon fibers according to the present invention can be prepared from the optically isotropic pitch fibers by controlling various preparation conditions such as the spinning temperature of the optically isotropic pitch. The reason for the above-mentioned advantage of the present invention is not fully elucidated, however it is presumed that the characterized preparation conditions of the optically isotropic pitch such as blowing with oxygen-containing gas as well as the melt blowing under high viscosity conditions greatly accelerate the homogenization and refinement of the carbon layer in the pitch.

To summarize the advantages obtained by the present invention, the pitch-based activated carbon fibers of the present invention have a high adsorption efficiency without decrease in mechanical strength because of their outstanding structure in which the pores that are regulated in both pore diameter and density and composed of numerous micropores with a pore diameter of 4 nm or smaller and ultramicropores in a proportion of at least 70% based on the total number of the pores are distributed with a uniform density in both the surface layer part and the inner part of the fiber which are allowed to three-dimensionally communicate with at least a part of the surrounding pores.

Accordingly, the pitch-based activated carbon fibers of the present invention are effectively utilized as adsorbents for low molecular organic compounds and inorganic compounds, adsorbents for trace amounts of radioactive substances, catalyst carriers, electrodes for secondary batteries and the like.

The present invention will be described in more detail with reference to the following examples; however, these examples are intended to illustrate the invention and are not to be construed to limit the scope of the invention.

Example 1

(1)Preparation of an optically isotropic pitch

A heavy oil having an initial boiling point of 480° C., a end boiling point of 560° C. and a softening point of 72° C. which was prepared from a petroleum oil-based catalytic cracking heavy oil by filtration, removal of catalyst and distillation was used as the raw pitch material. The raw pitch material was heat treated under nitrogen blowing at 400° C. to produce a heat treated pitch material containing about 5% by weight of optically anisotropic components. The heat treated pitch was settled at 330° C. to precipitate the optically anisotropic components. Then the lower part containing the optically anisotropic components was removed from the settled pitch. Into a 200 L (liter) reactor, 140 kg of the resultant pitch material was charged and heat treated at 330° C. for 10 hours while blowing air at a rate of 7 NL/kg.minute to obtain a pitch intermediate having a softening point of 250° C. and QI (the amount of the component insoluble in quinoline) of 7.2% by weight at a pitch yield of 60.2% by weight.

The pitch intermediate was filtered with a 0.5 $\mu$m disc filter at 300° C. to obtain a pitch having a softening point of 247° C. and QI of 1% by weight or less.

Into a 10 L (liter) reactor, 2.0 kg of the pitch thus obtained was charged and heat treated at 350° C. for 0.5 hour under vacuum of 5.0 Torr and while blowing nitrogen at a rate of 0.5 NL/kg.minute to obtain an optically isotropic pitch having a softening point of 276° C. and QI of 1% by weight or less at a pitch yield of 95% by weight.

The pitch thus obtained was observed with a polarized microscope and found to be free from optically anisotropic components.

(2)Preparation of a pitch fiber

The optically isotropic pitch thus obtained was spun by the use of a spinneret in which 1000 nozzle holes having a diameter of 0.2 mm were arranged in a row in a slit of 2 mm width to prepare a pitch fiber at a pitch delivery rate of 1,000 g/minute, a pitch temperature of 350° C., a heated air temperature of 380° C., and a air blow speed of 320 m/second.

(3)Preparation of pitch-based activated carbon fibers.

The spun fiber as obtained in the preceding item (2) was collected on a belt having a collecting part made of a 35 mesh stainless steel by sucking from the back of the belt.

The mat-like sheet of the pitch fiber thus obtained was infusibilized in air by raising the temperature thereof at a rate of 10° C./minute up to the maximum temperature of 310° C., followed by activatation at 1,000° C. for 10 minutes in an atmosphere containing 35% by weight of steam.

The activated carbon fiber was thus prepared in a yield of 20% by weight, and had a specific surface area [BET] of 2500 $m^2/g$. Then, a measurement was made of pore distribution in the resultant pitch-based activated carbon fibers by binarizing treatment for the image of the cross section of the fiber as observed with an transmission electron microscope. As a result, the proportion of the number of ultramicropores with a pore diameter of 0.5rim or smaller to the total number of pores with a pore diameter of 4 nm or smaller was 79%, and any pore exceeding 4 nm in pore diameter was not observed. In addition, the pores with a diameter of 4 nm or smaller were distributed through out the fiber including the surface layer part and the inner part within a difference in pore density of 5%. The fractal dimension was found to be 2.6.

Example 2

The procedure in Example 1 was repeated except that heat treatment under reduced pressure in the second stage in Example 1-(1) was carried out under blowing with nitrogen containing 0.1% by weight of steam. Thus, there was obtained an optically isotropic pitch having a softening point of 277° C. and QI of 1% by weight or less at a pitch yield of 94% by weight. The resultant pitch was made into activated carbon fibers in the same manner as in Example 1.

The pitch-based activated carbon fiber was thus prepared in a yield of 30% by weight, and had a specific surface area (BET) of 2280 $m^2/g$. The proportion of the number of ultramicropores with a pore diameter of 0.5 nm or smaller to the total number of pores with a pore diameter of 4 nm or smaller was 82%, and any pore exceeding 4 nm in pore diameter was not observed. In addition, the pores with a diameter of 4 nm or smaller were distributed throughout the fiber including the surface layer part and the inner part with a uniform pore density.

EXAMPLE 3

The mat-like sheet of the infusibilized pitch fiber prepared in Example 1 was moderately carbonized in nitrogen by raising the temperature thereof at a rate of 5° C./minute up to the maximum temperature of 700° C., followed by activatation in the same manner as in Example 1.

The pitch-based activated carbon fiber was thus prepared in a yield of 55% by weight, and had a specific surface area (BET) of 1560 $m^2/g$. The proportion of the number of ultramicropores with a pore diameter of 0.5 nm or smaller to the total number of pores with a pore diameter of 4 nm or smaller was 88%, and any pore exceeding 4 nm in pore diameter was not observed. addition, the pores with a diameter of 4 nm or smaller were distributed through out the fiber including the surface layer part and the inner part with a uniform pore density.

EXAMPLE 4

The mat-like sheet of the infusibilized pitch fiber prepared in Example 1 was activated at a steam concentration of 35% by weight at a temperature of 920° C. for 10 min. The pitch-based activated carbon fiber was thus prepared in a yield of 73% by weight and had a specific surface area (BET) of 720 $m^2/g$. The proportion of the number of ultramicropores with a pore diameter of 0.5 nm or smaller to the total number of pores with a pore diameter of 4 nm or smaller was 92%, and any pore exceeding 4 nm in pore diameter was not observed. In addition, the pores with a diameter of 4 nm or smaller were distributed throughout the fiber including the surface layer part and the inner part within a difference in pore density of The fractal dimension was found to be 2.2.

What is claimed is:

1. A porous optically isotropic pitch-based activated carbon fiber having a pore size distribution such that from 70 to 92% of the pores having a pore diameter of 4 nm or smaller are ultramicropores having a pore diameter of 0.5 nm or smaller.

2. The activated carbon fiber according to claim 1, wherein the specific surface area, as determined by the BET method, is in the range of 500 to 3000 $m^2/g$, and the pores consist substantially only of the pores having a pore diameter of 4 nm or smaller which communicate with at least a portion of the surrounding pores in all three dimensions and which are distributed in uniform density throughout the fiber including the surface layer portion and the inner portion of the fiber.

* * * * *